United States Patent [19]

Orbanes et al.

[11] 4,394,018

[45] Jul. 19, 1983

[54] ELECTRONIC LOGIC GAME

[75] Inventors: Philip Orbanes, Topsfield, Mass.; Julius Cooper, New Hyde Park, N.Y.

[73] Assignee: Ideal Toy Corporation, Hollis, N.Y.

[21] Appl. No.: 403,232

[22] Filed: Jul. 29, 1982

Related U.S. Application Data

[63] Continuation of Ser. No. 86,606, Oct. 19, 1979, abandoned.

[51] Int. Cl.[3] ..... A63F 3/00

[52] U.S. Cl. ..... 273/237; 273/1 E; 364/410

[58] Field of Search ..... 273/1 E, 237; 364/410

[56] References Cited

U.S. PATENT DOCUMENTS 4,051,605 10/1977 Toal et al. ..... 364/410
4,059,272 11/1977 Pullman ..... 273/237
4,189,779 2/1980 Brautingham ..... 273/237
4,235,442 11/1980 Nelson ..... 273/237

FOREIGN PATENT DOCUMENTS 11420 5/1980 European Pat. Off. ..... 273/1 E
2371215 7/1978 France ..... 273/237

OTHER PUBLICATIONS

"Electronic Games Round Up", *Creative Computing*, Dec. 1979, pp. 17–18.

*Primary Examiner*—Russell E. Adams
*Attorney, Agent, or Firm*—Richard M. Rabkin

[57] ABSTRACT

A microprocessor-based electronic logic game gives players clues to an event, such as a murder, identifies a group of suspects, and permits each player to ask private questions of the suspects to logically narrow down the possibilities to a single culprit. A keyboard and a visual display provide input and output respectively.

1 Claim, 9 Drawing Figures

FIG. 3
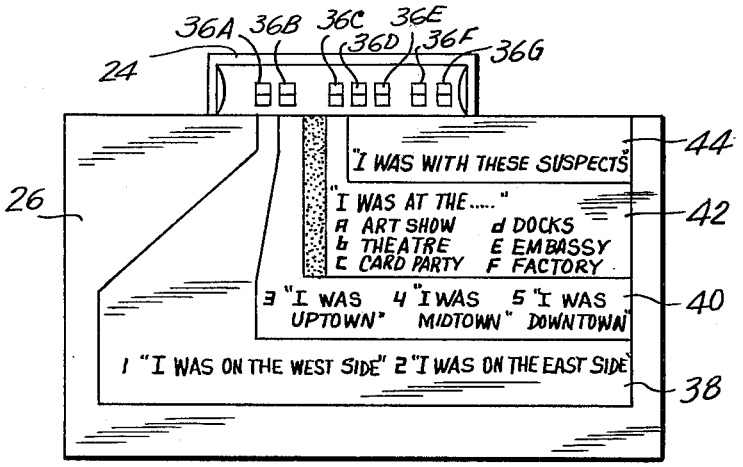
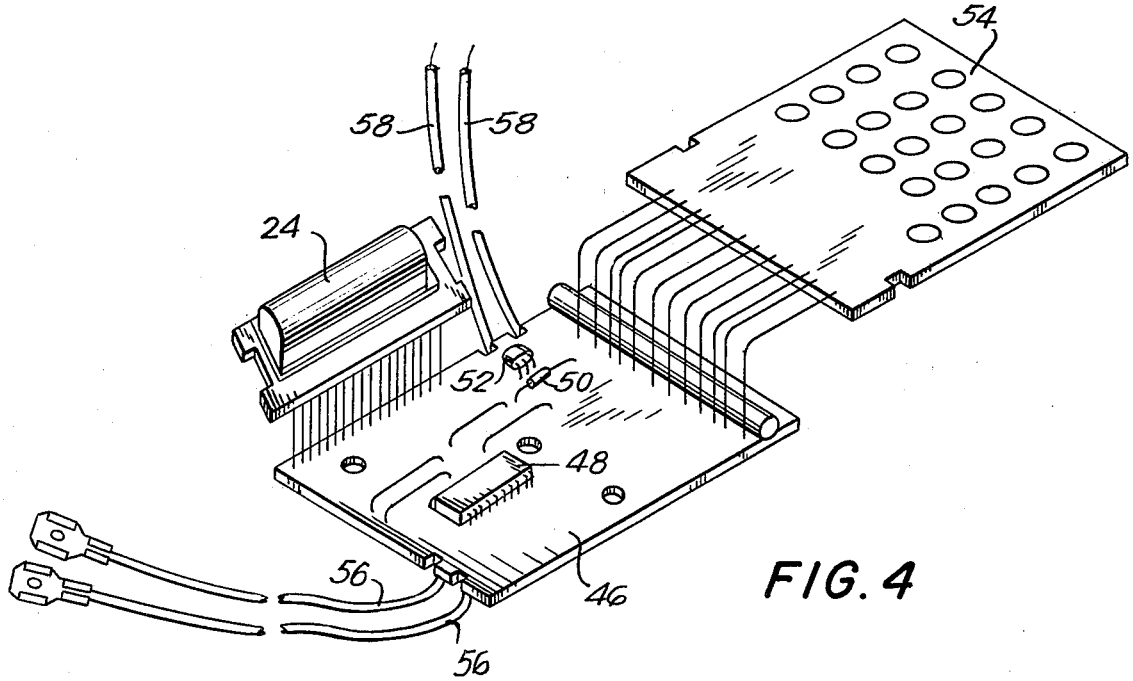
FIG. 4

ELECTRONIC LOGIC GAME

This is a continuation of application Ser. No. 86,606 filed Oct. 19, 1979, now abandoned.

BACKGROUND OF THE INVENTION

This invention relates generally to games and more particularly to electronic games in which the players interact with the game to produce a desired result.

Electronic board games are known. Such games require for example, a sequence of events to be repeated, a correlation between an input and an output to be determined, or a particular response to a particular stimulus to be provided.

OBJECTS AND SUMMARY OF THE INVENTION

It is an object of the present invention to provide an electronic logic game that provides amusement for a group of players.

It is a further object of the present invention to provide an electronic logic game that provides clues which can be logically combined to lead to a solution.

It is a further object of the present invention to provide an electronic detective logic game in which a simulated crime report is produced and grilling of suspects reveals clues which can be used to determine the culprit.

In accordance with a preferred embodiment of the invention, there is provided an electronic logic game having a keyboard for providing player input to the game and a visual display and an audio transducer for providing output from the game. The keyboard may be employed to identify and grill suspects and the output devices may be employed to provide information and answers.

A microprocessor produces a police report including the identity of a murder victim selected from a group of potential suspects and describes the location of the crime. The microprocessor assembles a set of clues regarding where the gun is located, where each of the suspects were located and who accompanied them at the time of the crime. After the police report additional information is provided by grilling individual suspects. As a suspect is identified for grilling, his alibi is displayed. An alibi may consist of information on where he was located, what he was doing and who he was with at the time of the crime. One of a number of predetermined questions may be asked of the suspect and the answers displayed may be used to sift the facts towards identifying the murderer. Each player is permitted one accusation in a game when he thinks he has enough information to identify the culprit. If the accusation is correct, he wins the game. If his accusation is incorrect, he is eliminated from the game and the game continues until either someone has won by correctly identifying the culprit or all players have lost by incorrectly identifying the culprit.

According to an aspect of the invention, there is provided an electronic logic game for play by at least one player, comprising electronic means for defining a selected set of logically related information, the logically related information having a unique solution, output means for outputting a first selected subset of the selected set to the at least one player, input means actuable by the at least one player for selectively interrogating the electronic means, the output means being operative in response to the input means for outputting at least a second selected subset of the selected set to the at least one player, means for accepting a proposed solution from the at least one player, and means for indicating whether the proposed solution is the unique solution.

The above, and other objects, features and advantages of the present invention will become apparent from the following description read in conjunction with the drawings in which like reference numerals designate the same elements.

BRIEF DESCRIPTION OF THE DRAWINGS

FIG. 3 shows a close-up view of the visual display and display-interpretation panel of FIG. 1;

FIG. 4 shows a perspective view of the physical layout of the interior of the embodiment of FIG. 1 ;

DETAILED DESCRIPTION OF THE PREFERRED EMBODIMENT

It will be understood that virtually any event can be employed as the generator of clues which the players can sift to arrive at a logical conclusion. However, for explicit description of a preferred embodiment, an electronic logic game is described in which an imaginary murder is committed and the object of the game is to determine who committed the act.

Figure 1:
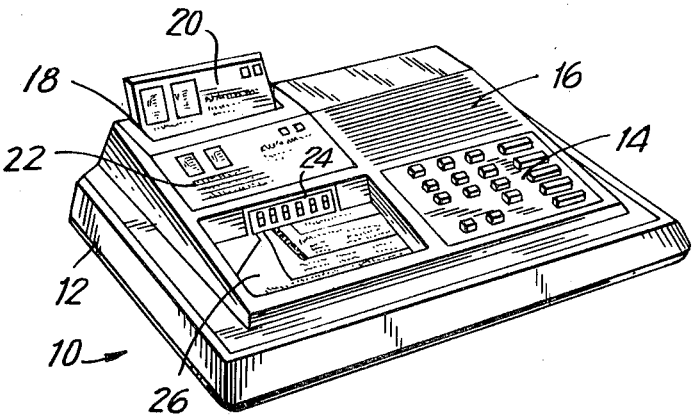
FIG. 1 shows a perspective view of an electronic logic game according to an embodiment of the invention.

Referring now to FIG. 1, there is shown an embodiment of an electronic logic game 10. A case 12 of any suitable material, but preferably of molded plastic, has a keyboard 14, a loudspeaker grill 16, a suspect card storage compartment 18 in which a plurality, suitably 20, of suspect cards 20 may be placed, a suspect card tray 22, a visual display 24 and a display-interpretation panel 26 immediately adjacent visual display 24. Any type of visual display 24 may be used, for example, light emitting diodes, liquid crystal display, vacuum fluorescent display, or other devices capable of displaying alphabetic, numeric and/or graphic material. In the preferred embodiment, visual display 24 is a plurality of light-emitting diodes.

Figure 2:
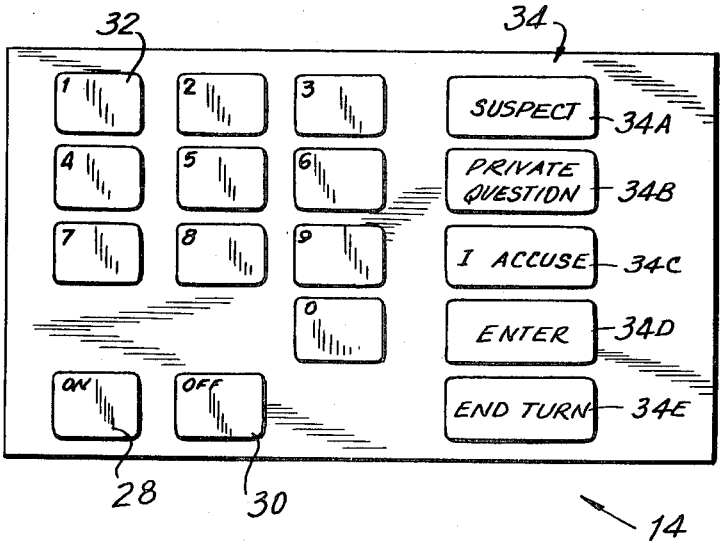
FIG. 2 shows a close-up plan view of the keyboard of FIG. 1.

Keyboard 14, shown in FIG. 2, includes an ON key 28, an OFF key 30, numeric input keys 32 for inputting digits 0–9, as well as a set of five function-identifying keys 34. Function-identifying keys 34 include a SUSPECT key 34A for identifying a specific suspect, a PRIVATE QUESTION key 34B for informing the game that a private question is to be asked, an I ACCUSE key 34C for identifying the culprit, an ENTER key 34D for entering questions or accusations, and an END TURN key 34E for passing play to the next player.

Referring now to FIG. 3, a more detailed view is shown of visual display 24 and display-interpretation panel 26. Visual display 24 contains a plurality, suitably seven 7-segment characters 36A–36G, each of which is capable of being selectively energized to represent any numeral from 0–9 and a limited set of alphabetic characters. Display-interpretation panel 26, keyed to specific groups of 7-segment characters 36A–36G provide interpretation of the displayed data.

Visual display 24 operates in three modes, namely, crime report, alibi and grilling. In the crime report mode, which is used to start the game, a number identifying the victim and a character identifying the scene of the crime are displayed. Display-interpretation panel 26 may be consulted to identify the activity in which the victim was engaged when he was murdered. Although numeric data may be used to indicate activity, in the preferred embodiment, the limited alphabetic display capability of a 7-segment character 36C is employed to desirably provide mnemonic assistance to the players. For example, the following alphabetic characters, keyed to activity area 42, are used to indicate an activity in which the victim was engaged at the time of the crime:

A: Art Show
b: Theater
C: Card Party
d: Docks
E: Embassy
F: Factory.

The alibi mode is automatically entered when a suspect is identified by a player keying in his or her suspect number. The suspect's alibi is displayed on visual display 24 and may consist of his or her location, activity and companion(s) at the time of the crime. The suspect's location is keyed to areas 38 and 40 and the suspect's activity is keyed to area 42 respectively on display-interpretation panel 26. In addition, characters 36D–36G, keyed to suspect area 44 on display-interpretation panel 26, may optionally be activated to indicate the number of one or two other suspects who were in the company of the suspect giving the alibi at the time of the crime.

In the grilling mode, characters 36D–36G are employed to provide direct answers (YES, NO, DON'T KNOW=00 000 00) to private questions selected from the five possible questions on each suspect card keyed in by a player. Display-interpretation panel 26 is not used in the grilling mode since the answers are given directly.

Referring now to FIG. 4, the interior of the device is seen to contain a circuit board 46 which may optionally have printed circuit wiring (not shown) thereon for interconnecting the parts of the apparatus. A microprocessor 48 and discrete components such as a resistor 50 and a transistor 52 are mounted on circuit board 46 and are secured there by any convenient means such as by the soldering of their leads to printed wiring (not shown). Visual display 24 is seen to be mounted to circuit board 46 by its leads. The plane of visual display 24 is tilted slightly as shown in order to improve the visibility of the display to someone forward of and slightly higher than it. A keyboard switch array 54 actuated by keyboard 14 is also connected to circuit board 46 by its leads. The keyboard switch array 54 may optionally be a second printed circuit board having conductors (not shown) printed thereon for making appropriate connections to the leads. Insulated conductors 56 provide connection from circuit board 46 to a power source (not shown) such as batteries. Insulated conductors 58 provide connection between circuit board 46 and a speaker (not shown).

Figure 5:
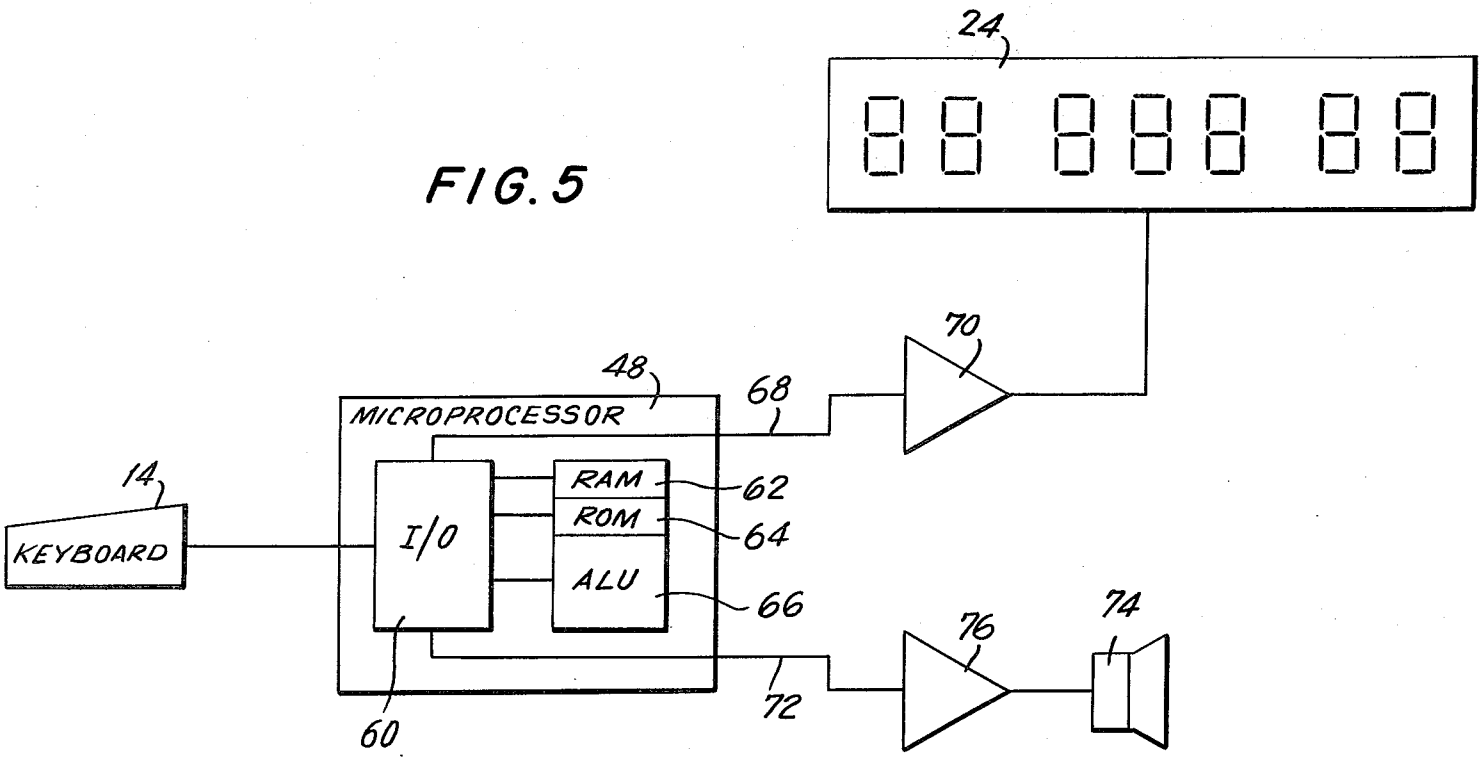
FIG. 5 shows a simplified block diagram of the embodiment of FIG. 1.

Referring now to FIG. 5, it is seen that keyboard 14 interfaces with an input-output section 60 of microprocessor 48. A random access memory 62, a read only memory 64 and an arithmetic and logic unit 66 in microprocessor 48 engage in two-way communication with input-output section 60 as indicated by the double-headed arrows therebetween. Input-output section 60 provides appropriate signals, which may be on a plurality of signal lines 68 to visual display 24 for selective illumination of characters thereof. A display driver circuit 70 may optionally be employed between input-output section 60 and visual display 24. Input-output section 60 also provides appropriate audio signals on an output line 72 to a loudspeaker 74 or other audio transducer. An audio amplifier 76 may be employed in output line 72 to drive loudspeaker 74.

Each of the suspect cards 20 (FIG. 1) may contain printed thereon front and side view mug-shots of one of the suspects and is identified by an appropriate number from 1–20. Each suspect card contains the name, occupation and marital status of the suspect and a list of five questions which may be asked of the suspect and all possible answers thereto. Suspects 1–10 are male (five odd numbered and five even numbered) and suspects 11–20 are female (five odd and numbered and five even numbered). The five questions which may be asked of a suspect are a subset of a total of 14 possible questions. The following tabulation identifies the question numbers, questions and possible responses:

| QUESTION NO. | QUESTION | POSSIBLE ANSWERS |
|---|---|---|
| 1 | Did the murderer go to the EAST SIDE? | YES, NO. |
| 2 | Did a MALE do it? | YES, NO. |
| 3 | What AREA did the murderer go to? | 3-Uptown, 4-Midtown, 5-Downtown |
| 4 | Was the MURDER WEAPON a .38? | YES, NO. |
| 5 | Where was the .38 hidden? | A b, C d, E F |
| 6 | Where was the .45 hidden? | A b, C d, E F |
| 7 | Which PLACE contained only 3 suspects? | A b, C d, E F |
| 8 | Did the murderer go to PLACE A, B or C? | YES, NO. |
| 9 | Were you on the EAST SIDE? | YES, NO. |
| 10 | Which AREA were you in? | 3-Uptown, 4-Midtown, 5-Downtown |
| 11 | Were you at PLACE A, B or C? | YES, NO. |
| 12 | Were you where a WEAPON was hidden? | YES, NO. |

-continued

| QUESTION NO. | QUESTION | POSSIBLE ANSWERS |
|---|---|---|
| 13 | Are an odd-numbered suspect's PRINTS on the .38? | YES, NO, OO OOO OO (DON'T KNOW) |
| 14 | Are an odd-numbered suspect's PRINTS on the .45? | YES, NO, OO OOO OO (DON'T KNOW) |

The following relates which five of the possible questions may be asked of each of the 20 suspects:

| | QUESTION NO. | | | | | | | | | | | | | |
|---|---|---|---|---|---|---|---|---|---|---|---|---|---|---|
| SUSPECT NO. | 1 | 2 | 3 | 4 | 5 | 6 | 7 | 8 | 9 | 10 | 11 | 12 | 13 | 14 |
| 1 | X | X | | | | | | | X | | | | X | X |
| 2 | | X | X | | | | | | X | | | | X | X |
| 3 | | | X | X | X | | | | | | | | X | X |
| 4 | | | | X | X | | | | X | | | | X | X |
| 5 | X | | | X | | | | | X | | | | X | X |
| 6 | | | | | X | X | | | | | | X | X | X |
| 7 | | X | | | X | | | | | | | X | X | X |
| 8 | | | X | | X | | | | | | | X | X | X |
| 9 | X | | | | X | | | | | | | X | X | X |
| 10 | | | | | | | X | X | | | | X | X | X |
| 11 | | | | | | X | X | | | | X | | X | X |
| 12 | | X | | | | X | | | | | X | | X | X |
| 13 | | | X | | | | X | | | | X | | X | X |
| 14 | X | | | | | X | | | | | X | | X | X |
| 15 | | | | X | | | X | | | | X | | X | X |
| 16 | | | | | | X | | X | | X | | | X | X |
| 17 | | X | | | | | X | | | X | | | X | X |
| 18 | X | | | | | | | X | | X | | | X | X |
| 19 | | | X | | | | | X | | X | | | X | X |
| 20 | | | | X | | | | X | | X | | | X | X |

By appropriate selection of suspect and question, a player can analyze the clues to eliminate all but the real culprit and can then accuse the culprit.

Figure 6:
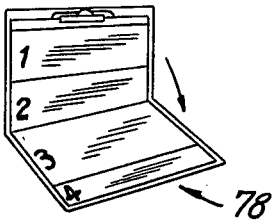
FIG. 6 shows a fact sheet employed in playing the game.

As shown in FIG. 6, a fact sheet 78 may be provided to each of the players for organizing their analysis of the clues. Fact sheet 78 is organized into sections 1–4 as follows: Section 1 contains the murder facts including such information as the murderer's sex, the weapon caliber, where the murderer fled and information about finger prints as it is derived. Section 2 provides for systematic recording of location data of suspects and murderer weapon in a "city" which is divided into uptown, midtown and downtown, each of which has a west side or an east side. Section 3 has spaces for recording suspects' alibis and answers to private questions during grilling and provides an orderly way of recording and cross-referencing this information. Section 4 provides a space for an accusation of a suspect when the player has sufficiently analyzed the clues to determine the culprit.

The rules of the game are contained in read only memory 64 (FIG. 5) and provide for a number of levels of difficulty, a number of players, and the manner of playing the game as will be understood from the following instructions and rules:

RULES

1. There will never be more than one odd-numbered and one even-numbered suspect, of the same sex, at any single location.

2. The murderer will never be at the location where the body was found (because the murderer fled the scene of the crime).

3. The murderer will never be at the location of the murder weapon (because the murderer avoids being near any possible evidence).

4. Fingerprints on the murder weapon must be identified as belonging to an odd or even numbered suspect. This information can only be given by a suspect: (a) of the same sex as the murderer; (b) who fled to the location of the murder weapon. All other suspects at the location of a weapon may (or may not) lie. This is the only instance where a suspect can lie. Suspects at locations where there is no weapon will answer "I don't know" (00 000 00 on the L.E.D. display).

EXAMPLE OF PLAY

Figure 7:
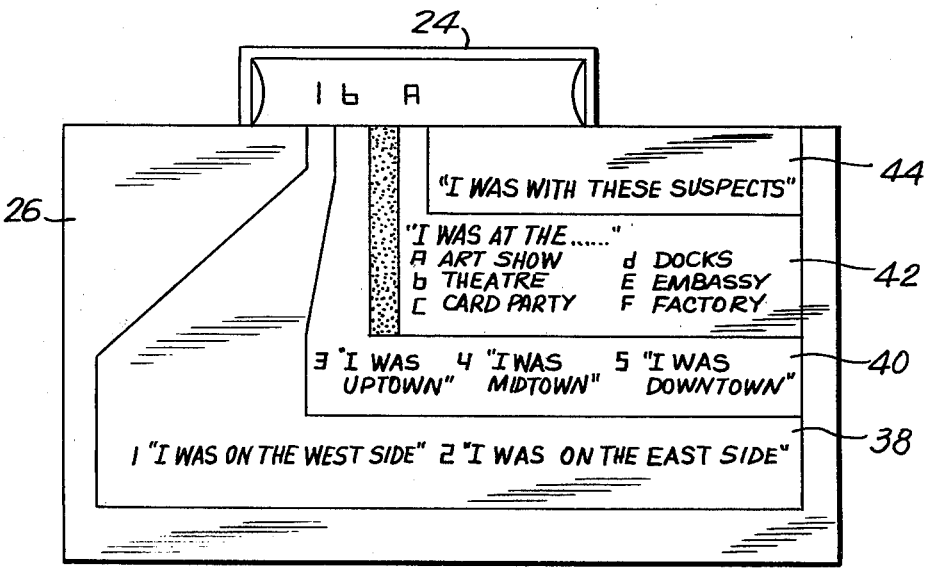
FIG. 7 shows the display of a crime report to which reference will be made in explaining the operation of the game.

1. Press "ON" key 28 (3 "bongs" will sound).
2. Decide level of play difficulty and press:
   Key #1 "Master Detective" (most difficult) or
   Key #2 "Sleuth" (less difficult) or
   Key #3 "Gumshoe" (least difficult).
3. Press Key #1, 2, 3 or 4 for number of players.
4. Press "ENTER" key 34D.
5. BANG! BANG! The crime is committed. A funeral dirge plays. Visual display 24 automatically provides a crime report showing the victim's number and location of the body. This information is read aloud. For example, visual display 24 may provide the crime report shown in FIG. 7. The victim is #16 (location areas 38 and 40 are disregarded in crime report display) the location is "A" (Art Show).

Remove victim's suspect card 20 from play.

6. Next:

All players record the crime report information on their case fact sheets 78 (In Section 1, "The Murder Facts").

All players draw a large "X" through the entire section where the body was found (Fact Sheet, Section 2, "Who was where!"). No suspects or weapons will be found there during the investigation.

7. The remaining 19 characters are now suspects and will be questioned by the players (the detectives).

QUESTIONING THE SUSPECT

The crime has been committed and details recorded on case fact sheets 78. Each player may now "grill" any one suspect in a turn. The suspect will first give an alibi, then answer private questions. Suspects always tell the truth, with one critical exception (see rule 4). Players have access to all suspect cards 20 during play. The same suspect may be further questioned by any player in subsequent turns, and a player may question the same suspect more than once. The murder victim cannot be interviewed. 00 000 00 (means I don't know) will appear on the display if you try to question the victim.

TO ASK THE SUSPECTS ALIBI

1. Place suspect card 20 on suspect card tray 22 (FIG. 4) in front of card storage compartment 18.
2. Press SUSPECT key 34A.
3. Press suspect's number on numeric input keys 32.
4. Press ENTER key 34D.

EXAMPLE: Suspect #7 is being questioned. Immediately after ENTER key 34D is pressed, visual display 24 displays the suspect's ALIBI. This information is explained on display-interpretation panel 26 beneath the readout. The alibi may read "I was on the west side (1) at the theater (B) with suspect 11".

Each suspect gives an alibi as his or her first response. The player questioning the suspect reads the alibi out loud.

Alibi information varies. In this example, the suspect has revealed 3 facts. Other suspects' alibis may consist of only one or two facts.

All players record this information on their fact sheets 78. In the case illustrated, first the information in Section 3 is recorded. Then Section 2 is marked with both suspect #7 and suspect #11 at the theater—plus locating the theater on the west side. This is the information received from the suspect #7's alibi.

NOTE: Of the 5 place locations the suspects could have fled to, 4 will always have an odd and even numbered female and an odd and even numbered male. One place will always have only 3 suspects . . . 2 of whom will be odd and even numbered suspects of the same sex.

THE CRUCIAL PRIVATE QUESTIONS

After the suspect's alibi is known, the player is allowed to ask private questions on the same turn.

The number of questions the player may ask in a turn depends on the level of difficulty at which the game is being played.

EXAMPLE: All the questions which may be asked of suspect #7 are on his suspect card 20. The computer will only answer the number of questions which are allowed in a turn (depending on the degree of difficulty that was keyed in).

TO ASK PRIVATE QUESTIONS

1. Press PRIVATE QUESTION key 34B.
2. Press QUESTION'S NUMBER on numeric input key(s) 32.
3. Press ENTER key 34D.

A direct answer (YES, NO, 00 000 00 [I don't know]) will appear on visual display 24. It is not necessary to refer to display-interpretation panel 26 since this is for suspect's alibis and victim's location only.

Only the player asking the private question sees the answer.

The sequence above must be followed for each private question which is asked in the same turn.

If a player should try to ask a suspect more private questions than allowed, a "bong" will sound and END will appear on visual display 24. If a player attempts (purposely or by accident) to ask a suspect a question number which does not appear on that suspect's card, visual display 24 flashes EE and docks the player one question of those the player is permitted to ask in that round. END TURN key 34E must be pressed before the next suspect can be questioned. If END TURN key 34E is not pressed, EE will appear on visual display 24 when the next suspect is questioned and will continue to appear until END TURN key 34E is pressed.

The next player, to the left, now questions a suspect.

TO SOLVE THE CRIME

To solve the crime, all the murder facts (Section 1, case fact sheet 78) must be known. Only one suspect fits all the facts—the murderer. Some facts may be determined by suspects' alibis and by private questions. Other facts can be deduced by pure logical reasoning. This is done as follows:

1. Private questions reveal (a) the murderer's sex (question 2), (b) whether the murder weapon was a .38 or .45 (questions 4, 5, 6) and (c) whether the fingerprints on the murder weapon belong to an odd or even numbered suspect (questions 13 and 14) (see rule 4).
2. It is possible to find out where the murderer has fled to from private questions and from suspects alibis.
3. Or murderer's identity can be deduced by obtaining information about other suspects. For example, it is found that the murderer was an odd-numbered male. If it is then determined that their respective locations establish the innocence of all odd-numbered males but one, the murderer's identity and where he fled to can be deduced (see Rules 1, 2, and 3).

TO MAKE AN ACCUSATION

A player must make only one accusation during a game. The accusation must be made at the beginning of a turn.

1. Press I ACCUSE key 34C.
2. Press suspect number on numeric input keys 32.
3. Press ENTER key 34D.

False accusation, "NO" flashes and BANG! BANG! The player is out of the game. An incorrect accusation automatically ends a turn.

Correct accusation and police sirens sound. The player wins. Visual display 24 flashes the murderer's number and "YES".

If all players, but one, have accused incorrectly, the final player must make an accusation at the beginning of his next turn.

If all players make incorrect accusations, the computer automatically gives the correct answer and plays the funeral dirge for all the dead detectives who have lost the game.

Figure 8:
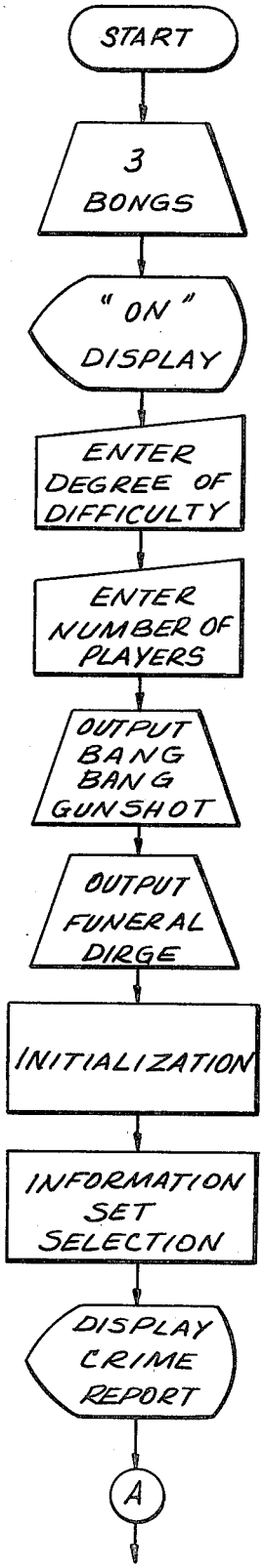
FIG. 8 shows part of a flow chart of the game.
Figure 9:
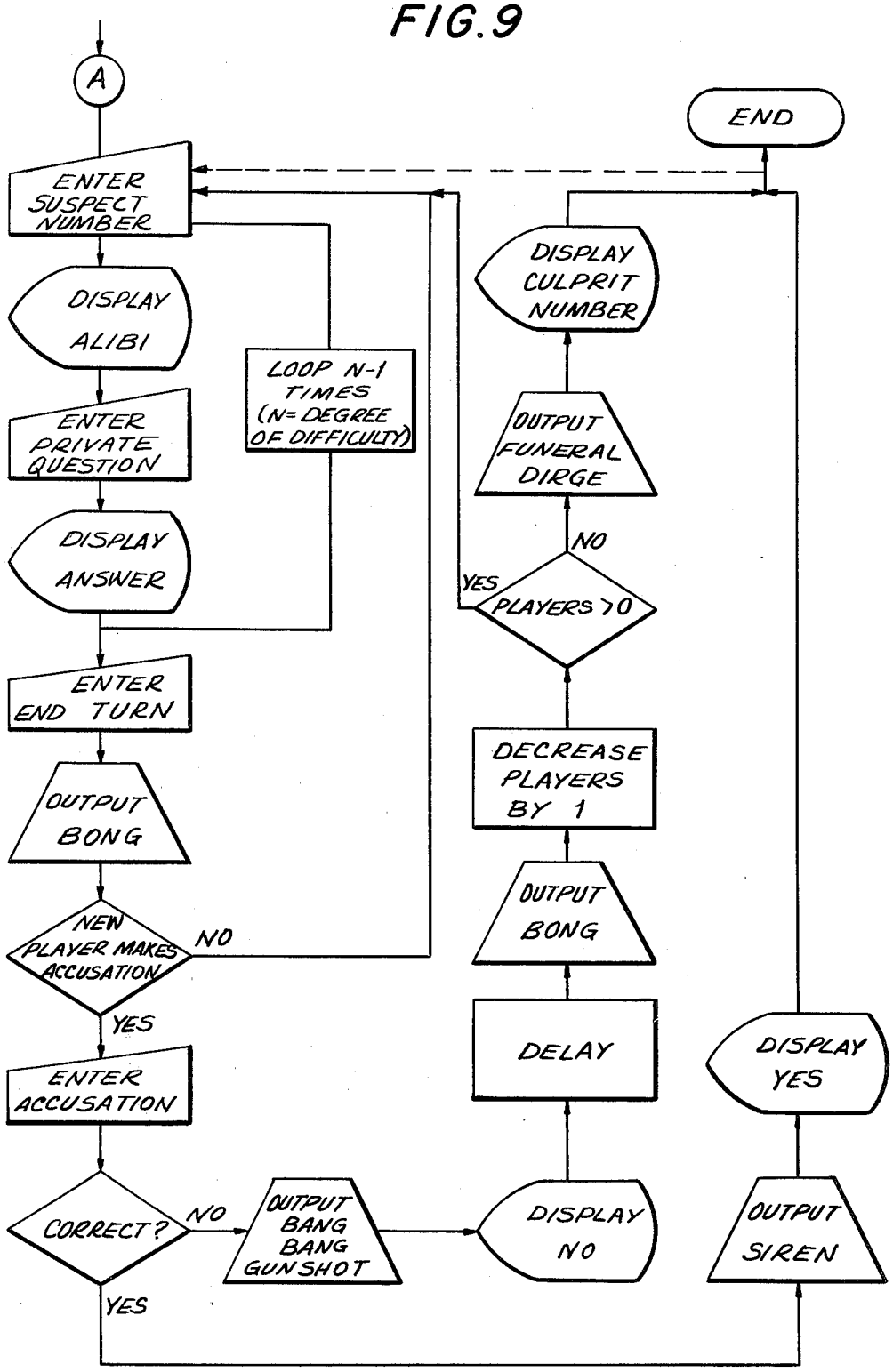
FIG. 9 shows the remainder of a flow chart of the game.

The play routine is illustrated in flow chart form in FIGS. 8 and 9. When the start key is pressed, three bongs are output on the loudspeaker and the visual display is activated to indicate that the game is ON. The players then enter the degree of difficulty (1, 2 or 3) and the number of players (1–4). Two gun shots and a funeral dirge are output on the loudspeaker. The game is then initialized by selection of a victim and the corresponding clues. The victim can be selected by the microprocessor randomly, pseudo-randomly or in a predetermined sequence. Alternatively, a player input (not shown) may be employed to select a specific victim and/or clues. A crime report is displayed showing the victim number and the location of the body.

Referring now to FIG. 9, play continues by entering a suspect number which then produces an alibi display for the selected suspect. A private question is asked during grilling of the selected suspect and the suspect's answer is displayed. The grilling operation is looped N-1 times, where N is the degree of difficulty. At the end of the grilling of a suspect an end of turn is entered. This produces a confirming bong and passes play to the next player.

The next player must first decide whether or not to make an accusation, if he does not make an accusation, he may then select and grill the same or another suspect in the manner previously described. If the next player elects to make an accusation, he enters the accusation identifying the suspect whom he believes to be the culprit. If he is correct, he is rewarded with an output of a European siren, a display of YES which may optionally be flashed on the display and the game ends. If the accusation is incorrect, a gun shot sound is output and a NO is displayed. After a predetermined delay, suitably one second, a single bong is output to indicate that play can be resumed. The initial number of players is decremented by one and the resulting number of remaining players is tested to determine whether it has reached zero. If the number of valid players is not equal to zero, grilling of the suspects continues by the remaining players. If the number of valid players has reached zero, a funeral dirge is output for the players (detectives), the identity of the culprit is displayed and the game may optionally end at this point. Alternatively, as indicated by the dashed line from the end of the game to the suspect entry block, players may be permitted to continue to interrogate suspects in order to satisfy their curiosity after the game is over.

If no entries are detected for a predetermined time, such as, for example, four minutes, the end may be entered and the game automatically shut off.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electronic logic game for play by at least one player to identify which one of predetermined "suspects" has committed a "crime", comprising:

a keyboard having manually actuable keyboard switches including an "on" key to initiate play, a "suspect" key to selectively establish a "suspect" questioning mode or a "suspect" accusation mode, numeric keys actuable to enter numerical data for identifying a "suspect" and further actuable to enter predetermined "questions", a "question" key actuable to enable said predetermined "questions" to be asked of the identified "suspect", an "end turn" key actuable to terminate the "questioning" of said identified "suspect", and an "accuse" key actuable to "accuse" an identified "suspect" of being guilty of said "crime";

a visual display including graphic means operable in response to the actuation of said "on" key to provide a visual display representing the location of said "crime" and the identity of the "suspect" who is a "victim" of that "crime", said graphic means being further operable in response to the actuation of said "question" key and a numeric key to provide a visual display representing an "answer" to a "question", and said graphic means being additionally operable in response to the establishing of a "suspect" questioning mode to provide a visual display of the "alibi" of said identified "suspect";

audio indicating means for indicating an erroneous "question" of an identified "suspect", for indicating a false "accusation" of an identified "suspect", and for indicating the correct "accusation" of an identified "suspect";

a plurality of "suspect" cards, each indicating the identity of a respective "suspect" and selected "questions" that may be asked of said respective "suspect"; and microprocessor means programmed to store, for each of said "suspects", data indicating the "alibi" of each "suspect" for each "crime", data indicating the "answer" of each "suspect" to each of said selected "questions", data indicating whether each "suspect" is a victim of each "crime", and data indicating whether each "suspect" is guilty of each "crime", said microprocessor means being initially operative to retrieve data stored therein indicating the "victim", "location" and "guilty" "suspect" of a "crime" and to operate said visual display for displaying information representing said "victim" and "location" of said "crime", said microprocessor means being operative in response to the actuation of keys identifying a respective "suspect" to retrieve the data indicating the "answer" of said identified "suspect" to a selected "question" and to operate said visual display for displaying information representing said "answer", and said microprocessor means being operative in response to the actuation of keys identifying an "accused" "suspect" to retrieve said data indicating whether the "accused" "suspect" is "guilty" and to operate said audio indicating means to indicate if said "accused" "suspect" is "guilty".

* * * * *